United States Patent [19]

Truyens

[11] Patent Number: 4,816,310

[45] Date of Patent: Mar. 28, 1989

[54] COLLAPSIBLE STRUCTURE

[76] Inventor: Hendrikus M. T. Truyens, Elburgkade 97, 1324 HL Almere, Netherlands

[21] Appl. No.: 32,485

[22] Filed: Mar. 30, 1987

[51] Int. Cl.[4] ..... E06B 9/06

[52] U.S. Cl. ..... 428/12; 160/136; 160/160; 403/53

[58] Field of Search ..... D25/49, 50; 160/160, 160/161, 84 H, 136; 211/202; 428/12; 403/53; 248/27.8

[56] References Cited

U.S. PATENT DOCUMENTS

| | | | |
|---|---|---|---|
| 320,974 | 6/1885 | Schreiber | 160/160 X |
| 352,660 | 11/1886 | Pitt | D25/50 X |
| 583,235 | 5/1897 | McCormick | 160/160 X |
| 942,545 | 12/1909 | Colidge | 403/53 |
| 1,095,238 | 5/1914 | Shadduck | D25/50 X |
| 1,251,213 | 12/1917 | Fritz | 160/160 X |
| 2,459,024 | 1/1949 | Gipson | 248/27.8 |
| 2,493,810 | 1/1950 | Gipson | 248/27.8 |
| 2,988,837 | 6/1961 | Hutton | 428/19 X |
| 3,885,616 | 5/1975 | Berkowitz | 160/215 |
| 4,606,394 | 8/1986 | Bannister | 160/135 X |

*Primary Examiner*—Henry F. Epstein

*Attorney, Agent, or Firm*—Lorusso & Loud

[57] ABSTRACT

A collapsible structure is provided comprising pairs of parallel posts interconnected by pairs of expansion link-like connecting rods. Connecting rods of each pair have their centers pivotably connected, wherein their outer ends are pivotably connected with the corresponding posts and wherein at least one outer end of each rod is slideable along the corresponding post. The pairs of parallel posts can be superimposed while corresponding posts are at their meeting ends hingedly connected for a zig-zag-like or an accordion-like collapsability in the vertical plane. Further pairs of parallel posts can be laterally positioned while adjoining posts of adjoining pairs of posts are hingedly connected for a substantial change in the angle enclosed by the planes extending through said pairs of posts.

13 Claims, 3 Drawing Sheets

COLLAPSIBLE STRUCTURE

The invention relates to a collapsible structure that is movable between a fold-out and a fold-up position.

Collapsible structures are known in numerous embodiments and mostly comprise rather complicated rod-assemblies. These known collapsible structures often have the disadvantage of being less versatile.

It is an object of the invention to provide a collapsible structure of this type overcoming this disadvantage in an easy but nevertheless effective way.

Therefore a collapsible structure is provided that is movable between a fold-out and a fold-up position, comprising pairs of parallel posts and pairs of connecting rods connecting said posts in the way of expansion links, said connecting rods of each pair of connecting rods having centers that are mutually pivotably connected, said connecting rods further comprising outer ends that are pivotably connected with posts of a corresponding pair of posts, whereas at least one outer end of each connecting rod further being slidable along the corresponding post.

The application of parallel posts and connecting rods extending between said posts for forming a kind of expansion link, enables the structure to take in several different positions in the fold-out position.

According to a preferred embodiment the collapsible structure according to the invention comprises pairs of posts that in the fold-out position of the structure, are positioned one on top of the other, wherein the separate posts are mutually aligned, whereas the adjoining outer ends of the posts are hingeably connected such, that said pairs of posts are zigzag-like collapsible towards a position in which the end-wise connected posts extend parallel to and at a short distance from each other.

Variation of the number of pairs of posts positioned one on top of the other offers an easy variation of the total height of the structure. Futher, due to the zigzag-like collapsability of the superimposed pairs of posts, in the fold-up position of the structure a small handy package is obtained.

According to another advantageous embodiment, the collapsible structure according to the invention comprises pairs of rods that in the fold-out position of the structure are positioned beside each other, wherein a first post of a first pair of posts is hingeably connected with an adjoining second post of an adjacent second pair of posts in such a way that, in the fold-out position of the structure, the angle enclosed by the planes extending through said adjoining first and second pairs of posts can be set freely.

Variation of the angle enclosed by the planes extending through said adjoining pairs of posts enables an easy variation of the shape of the fold-out structure. The structure can be positioned such that its base can form several different geometric shapes, such as triangles, squares, polygons or sections thereof.

According to a handy embodiment of the collapsible structure according to the invention each hinge means comprises a vertical and a horizontal hinge-axis, both said axes extending substantially parallel to the plane of the corresponding pair of posts, the horizontal hinge-axis being connected with the horizontal hinge-axis of the corresponding hinge means of a post positioned thereabove or therebelow through a first hinge lip, the vertical hinge-axis being connected with the vertical hinge-axis of the corresponding hinge means of an adjoining post of an adjacent pair of posts through a second hinge lip.

As a result the collapsability of the posts, that in the fold-out position of the structure are aligned, as well as the free setting of posts of adjacent pairs of posts positioned beside each other is obtained in an easy way. Hereby the hinge lips connecting the vertical hinge-axes of adjoining hinge means do not obstruct the hinge motion of the hinge lips connecting the horizontal hinge-axes of adjoining hinge means and vice versa.

Further it is advantageous when said posts are provided with a hollow open profile having an open side, the open sides of the posts of each pair of posts being directed towards each other, whereas the posts and the corresponding connecting rods are connected at connecting points that are positioned entirely within said open profiles of each post.

Due to this in the fold-up position of the structure or if only part of the structure is fold-up the connecting rods are not visible so that the collapsible structure has an esthetic appearance.

If finally both outer ends of each connecting rod are slidable along the corrresponding post, which post further comprises two abutment means for defining the relative position of the connecting rods in the fold-out position of the structure, the structure can obtain in its fold-out position an extremely stable position.

BRIEF DESCRIPTION OF THE DRAWING

Hereafter the invention will be explained further by means of the drawing, in which is illustrated an embodiment of the collapsible structure according to the invention.

Figure 1:
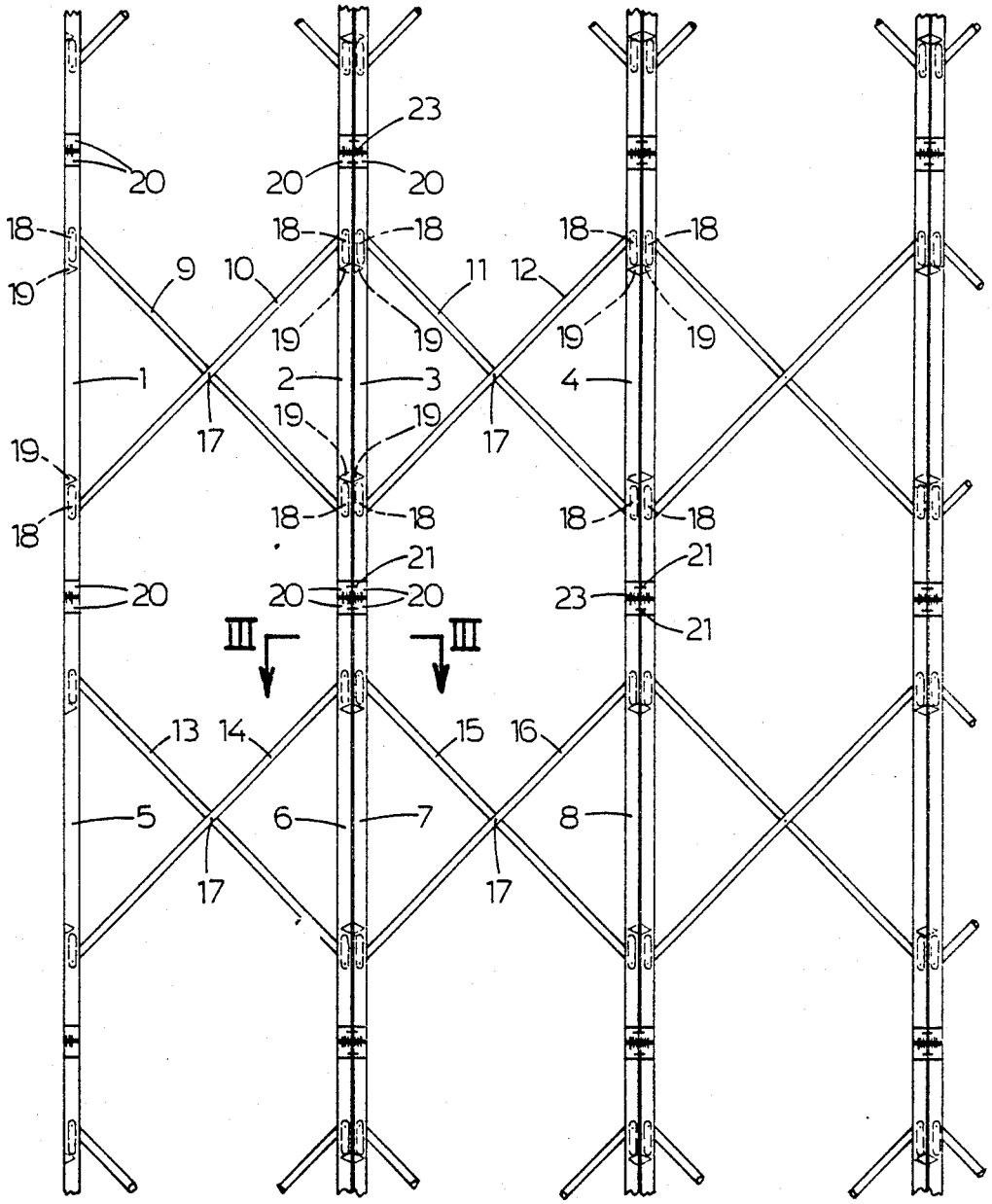
FIG. 1 shows an elevational front view of a section of a structure according to the invention in its fold-out position.

The collapsible structure visible in FIG. 1 that is positioned in its fold-out position, comprises a large number of pairs of parallel posts 1, 2; 3, 4; 5, 6; 7, 8, and pairs of connecting rods 9, 10 and 11, 12 and 13, 14 and 15, 16, respectively, connecting the pairs of posts 1, 2; 3, 4; 5, 6; 7, 8 in the way of expansion links. The number of parallel posts and the number of connecting rods depends on the overall dimensions of the structure, and can be chosen freely.

The connecting rods, such as the connecting rods 9 and 10, have centers that are mutually pivotably connected by pivots 17. These pivots 17 can have different shapes, for example such, that the connecting rods are detachable in a certain relative angular position.

The outer ends of the connecting rods 9–16 are pivotably connected with the posts of the corresponding pair of posts 1–8. In the illustrated embodiment according to FIG. 1 the outer ends of the connecting rods 9–16 are pivotably connected with sliding blocks 18, as illustrated at the pair of connecting rods 9, 10, said sliding blocks 18 being slidable along guidings in the posts. These guidings will be illustrated further with reference to FIG. 3.

For obtaining a collapsability of the structure shown it is necessary, that at least one outer end of each connecting rod 9–16 is slidable along the corresponding post 1–8, this in contrary to the embodiment shown, in which both outer ends of each connecting rod 9–16 are slidable along the corresponding posts 1–8.

For defining the position of the connecting rods 9–16 in the fold-out position of the structure each post 1–8 comprises abutment means 19 that, in FIG. 1, are only shown schematically.

Figure 2:
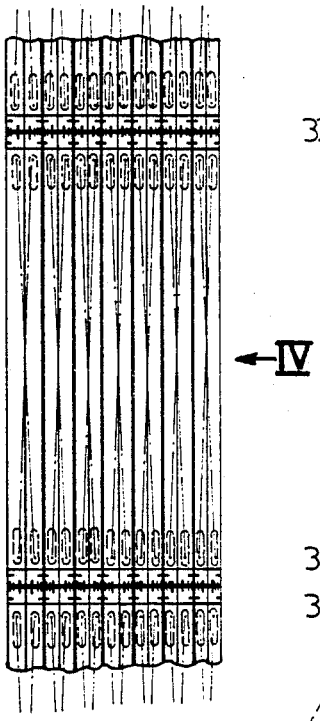
FIG. 2 shows an elevational front view of the structure according to FIG. 1 in a partially fold-up position.

During collapsing the structure from the fold-out position shown in FIG. 1 towards the partially fold-up position shown in FIG. 2 the outer ends of the connecting rods 9–16 together with their sliding blocks 18 slide apart in opposite directions along the posts 1–8, until the position is reached shown in FIG. 2. As will appear from FIG. 3 the posts 1–8 are provided with a hollow open profile wherein the open sides of the posts 1–8 of each pair of posts 1, 2; 3, 4; 5, 6; 7, 8 are directed towards each other, whereas the connecting points between the sliding blocks 18 positioned in said posts 1–8 and the connecting rods 9–16 are positioned entirely within said open profiles of each post. Due to this it is possible that the connecting rods 9–16 are no more visible in the position shown in FIG. 2, and that the posts of one pair abut. This offers a compact fold-up position.

As appears from FIG. 1 the structure comprises in its fold-out position a number of pairs of posts that are positioned beside each other, such as the pairs 1, 2 and 3, 4 or the pairs 5, 6 and 7, 8. Always a first post of a first pair of posts is hingeably connected with the adjoining second post of an adjacent second pair of posts. For example post 2 is hingeably connected with post 3, whereas post 6 is hingeably connected with post 7.

Figure 3:
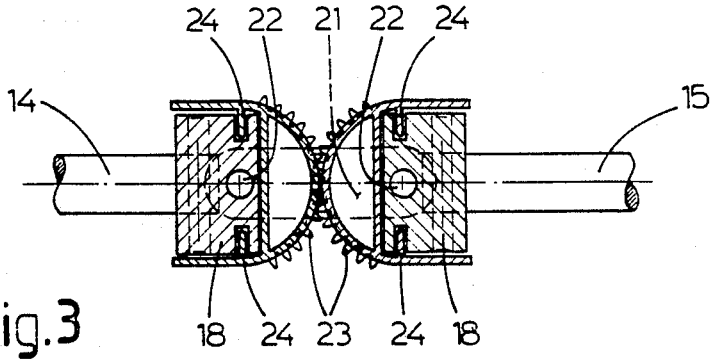
FIG. 3 shows a cross section according to III—III in FIG. 1, illustrated on a larger scale.

For obtaining the mentioned hingeable connection the posts 1–8 comprise at their outer ends hinge means 20. The hinge means 20 of adjoining posts 2 and 3 or 6 and 7 are mutually connected through a horizontal hinge lip. Each horizontal hinge lip 21 can pivot with each of its outer ends around vertical hinge-axes of each of the hinge means 20 and is mounted in these hinge means 20. In FIG. 3 these vertical hinge-axes 22 and the hinge lip 21 connecting these hinge-axes 22 are shown clearly.

Further adjoining posts 2 and 3 or 6 and 7 comprise co-operating toothings 23, so that only a rolling mutual motion of both posts 2 and 3 or 6 and 7 will be possible relative to each other. In this way it is possible, that the angle enclosed by the planes extending through adjoining pairs of posts, such as the pairs 1, 2 and 3, 4 or 5, 6 and 7, 8, can be set freely in the fold-out position of the structure. It is emphasized, that the toothing 23 in the structure according to FIG. 1 is positioned on the hinge means 20. But it is also possible that this toothing is provided on the posts themselves.

In FIG. 3 the mutual co-operation between the toothings 23 on the adjoining hinge means is illustrated clearly. During carrying out a rolling mutual motion of the hinge means or the posts connected thereto a rotation around these vertical hinge-axes 22 occurs, so that the enclosed angle is changed.

Further FIG. 3 shows a sliding block 18 being guided by guidings 24. In the sliding block 18 a connecting rod 14 or 15 is pivotably mounted with its one outer end. Also it is clearly visible that the posts comprise a hollow open profile for fully housing the connecting rods in the fold-up position of the structure.

Figure 4:
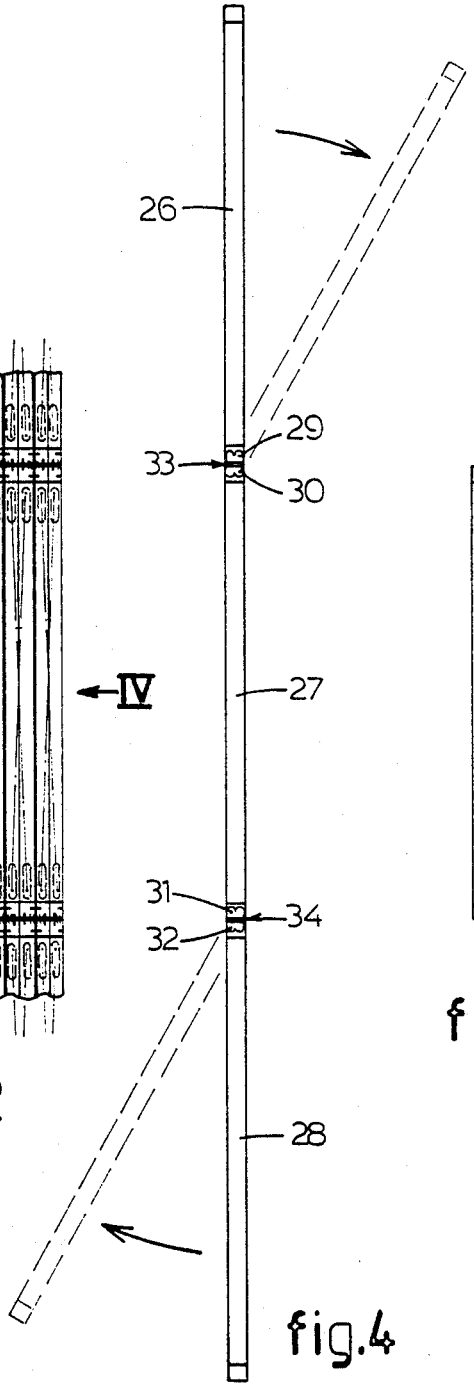
FIGS. 4 and 5 show a part of the collapsing motion of a structure according to the invention.
Figure 5:
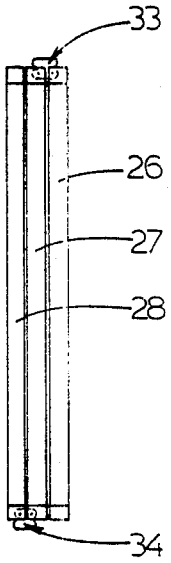

As appears from FIG. 1 the illustrated structure further comprises pairs of posts that, in the fold-out position of the structure are positioned one on top of the other, such as the pairs 1, 2 and 5, 6 or 3, 4 and 7, 8, of which the separate posts are aligned. The adjoining outer ends of the posts, here the hinge means 20, are hingeably connected such that the pairs of posts are zigzag-like collapsable towards a position, in which the posts connected with their outer ends extend parallel to and at a short distance from each other. This is illustrated schematically in FIGS. 4 and 5 that show three posts 26, 27 and 28. Post 26 comprises a horizontal hinge-axis 29, whereas post 27 comprises horizontal hinge-axes 30 and 31 and post 28 finally comprises a horizontal hinge-axis 32. The hinge-axes 29 and 30 of the posts 26 and 27, respectively, are positioned opposite to each other and are connected through a vertical hinge lip 33. Correspondingly the horizontal hinge-axes 31 and 32 of the posts 27 and 28, respectively, are mutually connected through a vertical hinge lip 34. (It is emphasized that the hinge lips 33 and 34 are in fact not mounted in the posts 26–28, but in the hinge means, that are positioned at the outer ends of these posts. For the described collapsing motion this does not make any difference.) The hinge-axes 29, 30 and 31, 32, respectively, are disposed laterally relative to the center line of the corresponding posts 26–28, enabling the collapse of these posts. By disposing these pairs of hinge-axes alternatively to the one and to the other side the posts 26–28 can be collapsed zigzag-like as shown in FIG. 5.

Figure 6:
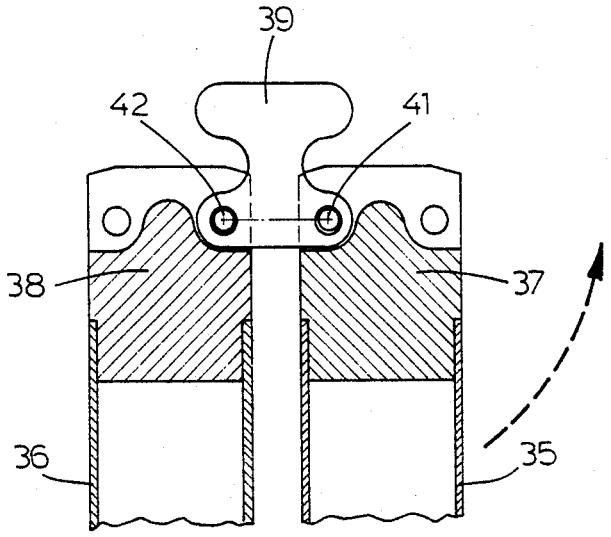
FIGS. 6 and 7 show a detail of the structure according to the invention during the collapsing motion according to FIGS. 4 and 5.
Figure 7:
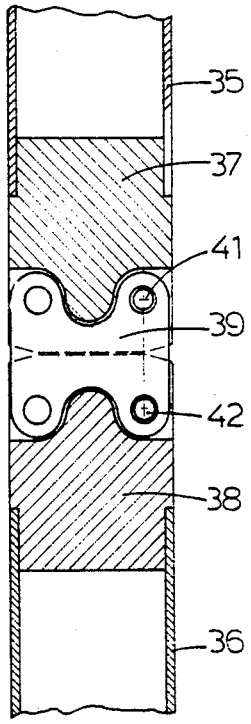

FIG. 6 and FIG. 7 show two posts 35, 36, that at their adjoining outer ends are provided with hinge means 37, 38. Between the horizontal hinge-axes 41, 42 of both hinge means 37, 38 a hinge lip 39 is provided enabling a motion of post 35 relative to post 36 as illustrated by the dotted arrow. Finally the fold-out position of the structure illustrated in FIG. 7 will be reached.

As appears clearly from FIGS. 6 and 7 the hinge lip 39 has a shape such that it acts also as centering means for the posts 35, 36 (or the hinge means 37, 38). Due to the corresponding recesses in the hinge lip 39 and the projections of the hinge means 37, 38 the position shown in FIG. 7 is maintained very effectively.

The collapsable structure according to the invention can be fold out and fold up in a very easy way, on the one hand offering a structure in its fold-out position that is very versatile, because the pairs of posts can be pivoted relative to each other through the horizontal hinge lips, on the outer hand obtaining a structure that in its fold-up position is very small and handy.

The structure can be used in its fold-out position for carrying panels, such as photo panels or the like.

The invention is not restricted to the embodiment described before, but can be varied widely within the scope of the invention.

I claim:

1. A collapsible structure that is movable between a fold-out and a fold-up position, comprising a plurality of horizontally and vertically related pairs of parallel posts having outer ends and a plurality of pairs of connecting rods connecting said posts in the way of expansion links, said connecting rods of each pair of connecting rods having centers that are mutually pivotably connected, said connecting rods further comprising outer ends that are pivotably connected with posts of a corresponding pair of posts, whereas at least one outer end of each connecting rod further being slidable along the corresponding post.

2. The collapsible structure according to claim 1, comprising pairs of posts that, in the fold-out position of the structure, are positioned vertically end to end, wherein the separate posts are mutually aligned, and wherein the adjoining outer ends of the posts are hingeably connected such, that said pairs of posts are zigzag-like collapsible toward a position in which the end-wise connected posts extend parallel to and at a short distance from each other.

3. The collapsible structure according to claim 1, comprising pairs of posts that in the fold-out position of the structure are positioned beside each other, wherein a first post of a first pair of posts is hingeably connected with an adjoining second post of an adjacent second pair of posts in such a way that, in the fold-out position of the structure, the angle enclosed by the planes extending through said adjoining first and second pairs of posts can be set freely.

4. The collapsible structure according to claim 3, wherein the adjoining posts of adjacent pairs of posts comprise collaborating toothings, said toothings permitting only a rolling mutual motion of the adjoining posts relative to each other.

5. The collapsible structure according to claim 2, wherein each post comprises at its outer ends hinge means enabling the collapse of the posts aligned in the fold-out position of the structure as well as the relative setting of the posts positioned besides each other.

6. The collapsible structure according to claim 5, wherein each hinge means comprises a vertical and a horizontal hinge-axis, both said axes extending substantially parallel to the plane of the corresponding pair of posts, the horizontal hinge-axis being connected with the horizontal hinge-axis of the corresponding hinge means of a post positioned thereabove or therebelow through a first hinge lip, the vertical hinge-axis being connected with the vertical hinge-axis of the corresponding hinge means of an adjoining post of an adjacent pair of posts through a second hinge lip.

7. The collapsible structure according to claim 6, wherein said first hinge lips extending between the horizontal hinge-axes act also as centering means for the posts.

8. The collapsible structure according to claim 4, wherein the toothings are provided on said hinge means.

9. The collapsible structure according to claim 1, wherein said posts are provided with a hollow open profile having an open side, the open sides of the posts of each pair of posts being directed towards each other, whereas the posts and the corresponding connecting rods are connected at connecting points that are positioned entirely within said open profiles of each post.

10. The collapsible structure according to claim 1, wherein both outer ends of each connecting rod are slidable along the corresponding post, which post further comprises two abutment means for defining the relative position of the connecting rods in the fold-out position of the structure.

11. A collapsible structure that is moveable between a fold-out and a fold-up position, comprising a plurality of horizontally and vertically related pairs of parallel posts having outer ends and a plurality of pairs of connecting rods connecting said posts as expansion links, said posts having a hollow open profile and an open side, the open sides of said posts of each said pair of posts facing toward each other, said posts and corresponding connecting rods being connected at connecting points that are positioned entirely within the open profiles of each post, and wherein said pairs of posts, in the fold-out position of said structure, are positioned vertically end to end, wherein the separate posts are mutually aligned, and the adjoining outer ends of said posts are hingeably connected such that said pairs of posts are zigzag-like or accordion-like collapsible towards a position in which the end-wise connected posts extend parallel to and at a short distance from each other, with said connecting rods of each said pair of connecting rods having centers that are mutually pivotably connected, said connecting rods further comprising outer ends that are pivotably connected with posts of a corresponding pair of posts, and with at least one outer end of each connecting rod being slidable along the corresponding post.

12. A collapsible structure that is moveable between a fold-out and a fold-up position, comprising a plurality of horizontally and vertically related pairs of parallel posts having outer ends and a plurality of pairs of connecting rods connecting said posts as expansion links, said pairs of posts in the fold-out position of the structure being positioned beside each other, wherein a first post of a first pair of posts is hingeably connected with an adjoining second post of an adjacent second pair of posts in such a way that, in the fold-out position of the structure, the angle enclosed by the planes extending through said adjoining first and second pairs of posts of adjacent pairs of posts can be set freely, and further wherein, the adjoining posts of said adjacent pair of posts have collaborating toothings, permitting only a rolling mutual motion of the adjoining posts relative to each other; and said connecting rods of each pair of connecting rods having centers that are mutually pivotably connected, said connecting rods further comprising outer ends that are pivotably connected with posts of a corresponding pair of posts, and with at least one outer end of each connecting rod being slidable along the corresponding post.

13. A collapsible structure that is moveable between a fold-out and a fold-up position, comprising a plurality of horizontally and vertically related pairs of parallel posts having outer ends and a plurality of pairs of connecting rods connecting said posts as expansion links, said posts having a hollow open profile and an open side, the open sides of said posts of each said pair of posts facing towards each other, said posts and corresponding connecting rods being connected at connecting points that are positioned entirely within said open profiles of each post, and wherein said pairs of posts, in the fold-out position of said structure, are positioned vertically end to end, wherein the separate posts are mutually aligned, and the adjoining outer ends of said posts are hingeably connected such that said pairs of posts are zigzag-like or accordion-like collapsible toward a position in which the end-wise connected posts extend parallel to and at a short distance from each other, and further wherein, in said fold-out position said pairs of posts are positioned beside each other, wherein a first post of a first pair of posts is hingeably connected with an adjoining second post of an adjacent second pair of posts in such a way that, in the fold-out position of the structure, the angle enclosed by the planes extending through said adjoining first and second pairs of posts of adjacent pairs of posts can be set freely, and further wherein the adjoining posts of said adjacent pair of posts comprise collaborating toothings, permitting only a rolling mutual motion of the adjoining posts relative to each other; and said connecting rods of each pair of connecting rods having centers that are mutually pivotably connected, said connecting rods further comprising outer ends that are pivotably connected with posts of a corresponding pair of posts, and with at least one outer end of each connecting rod being slidable along the corresponding post.

* * * * *